United States Patent [19]

Wiener et al.

[11] Patent Number: 4,602,535

[45] Date of Patent: Jul. 29, 1986

[54] LOCKING-MECHANISM FOR PREVENTING PREMATURE OPENING OF A TOOL

[75] Inventors: Hans Wiener, Täby; Hans Undin, Åkersberga, both of Sweden

[73] Assignee: C. A. Weidmuller GmbH & Co., Fed. Rep. of Germany

[21] Appl. No.: 706,929

[22] Filed: Feb. 28, 1985

[30] Foreign Application Priority Data

Mar. 14, 1984 [SE] Sweden ..... 8401418

[51] Int. Cl.[4] ..... B65B 7/02

[52] U.S. Cl. ..... 81/313; 81/323; 81/338

[58] Field of Search ..... 81/313, 315, 318, 323, 81/338; 74/17.5

[56] References Cited

U.S. PATENT DOCUMENTS 2,777,345 1/1957 Reider ..... 81/313

4,158,302 6/1979 O'Loughlin ..... 81/313

4,170,154 10/1979 Izraeli ..... 81/313

*Primary Examiner*—Frederick R. Schmidt

*Assistant Examiner*—Maurina Rachuba

*Attorney, Agent, or Firm*—L. Lawton Rogers, III

[57] ABSTRACT

A mechanism for preventing premature opening of a tool having two elongate handles comprising a carrier having a row of teeth at one edge and a spring-affected, pivotable pawl co-operating with the row of teeth. The pawl operates as a bistable rocker swingable by end stops at both ends of the row of teeth from a first lateral position for engagement with the row through an instable middle position into a second engagement-free lateral position. The two ends of the spring affecting the pawl and a pivot pin on which the pawl is mounted lie along one straight line when the pawl passes through the instable middle position.

13 Claims, 7 Drawing Figures

LOCKING-MECHANISM FOR PREVENTING PREMATURE OPENING OF A TOOL

SUMMARY OF THE INVENTION

The invention refers to a locking mechanism for a pliers-like apparatus or tool, i.e. an apparatus or a tool which is provided with two elongate handles which can be swung towards one another and away one from another, and which drive working means such as jaws. The nature of the working means or of their movement (e.g. a scissors-like or a vice-like movement), and the manner in which motion is transferred from the handles to the jaws is irrevelent from the point of view of the present invention.

By "locking mechanism" is understood in the present description a mechanism which prevents premature opening of the tool, i.e. prevents that the movement of the handles (and thereby also of the jaws) one towards the other ("closing of the pliers") be followed by a reverse movement one from another ("opening of the pliers") before the first named movement has been fully terminated. Thereby is achieved that workpieces which have not been completely treated (e.g. completely crimped in a pair of crimping pliers) cannot be removed from the jaws.

Locking mechanisms of the kind aforesaid are known, and they comprise a straight or a circular row of teeth attached to one handle, and a pawl with a tip for engagement with said teeth, said pawl being pivotally attached to the other handle and constantly affected by a spring. The tip engages the row of teeth in such a way that a relative motion in the sense of an approachment of the handles must continue so long till the tip reaches a reversing gap arranged at one end of the row of teeth and which enables to the spring-affected pawl to swing out of engagement with the row of teeth.

The primary object of the present invention is to improve the locking mechanism of the above kind so that the angle of aperture of the two handles, which is necessary for the transition of the handles from the opening movement to the closing movement, i.e. the transition of the locking mechanism from the non-engagement position into the engagement position, becomes smaller.

In accordance with the present invention, a locking mechanism for preventing premature opening of a tool which has two elongated handles and two jaws affected by said handles comprises a carrier of a row of teeth extending between a first end and a second end, said carrier being pivotally connected to one of the handles; a pawl pivotally mounted on a pivot pin and having an engagement part for engagement with said row of teeth; a spring means constantly affecting the pawl and mounted on one end at a first fixing point to the pawl, and on the other end at a second fixing point to the tool. The pawl is arranged to operate as a bistable rocker swingable from a first lateral position for engagement with the row of teeth, through an instable middle position, into a second engagement-free lateral position. A first and a second end stop, which on impact with the pawl rock it from one lateral position through the middle position into the second lateral position, project—relative to the row of teeth at the said first and second ends, said first and second fixing points and said pivot pin lying all, in the middle position of the pawl, on one straight line. A side stop defines said second engagement free lateral position as a position in which the pawl as a whole remains in the operative field of this end stop by which it, upon impact, is swung back from the second lateral position into the first lateral position.

Thus is eliminated the gap, which heretofore was necessary for the transition of the locking mechanism from one mode into the other and which had to be long enough as to allow a swinging movement of the pawl. Another object of the invention is to enable, in a preferred embodiment, individual setting of the begining and/or end of the closing movement of the handles.

The various features of novelty which characterize the invention are pointed out with particularity in the claims annexted to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
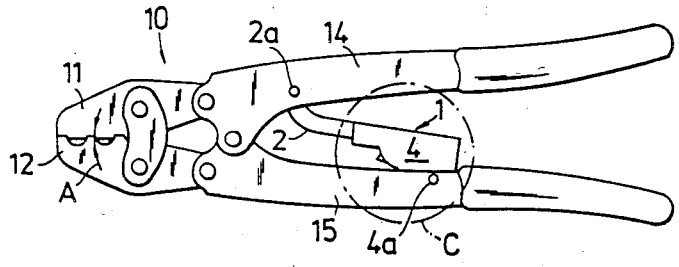
FIG. 1 and FIG. 2 are side elevational views of two pairs of pliers which are provided with a first embodiment of the locking mechanism according to invention.
Figure 2:
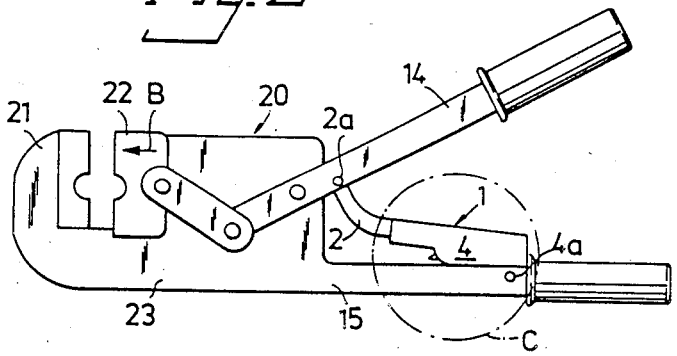

Referring to the drawings, wherein like reference characters designate like parts throughtout the several figures, a pair of pliers 10 according to FIG. 1 has two elongate handles 14, 15 by which are driven two jaws 11, 12. In order that a closing movement in the sense of arrow A always is completely terminated, are the pliers 10 provided, essentially in the region C shown on a greater scale in FIG. 3, with a locking mechanism 1 according to the present invention. The pair of pliers 20 of FIG. 2 differs from the pair of pliers 10 principally in that one of the elongate handles, viz. handle 14, drives a straight-line reciprocating jaw 22, the other handle 15 and the other jaw 21 being rigidly affixed to a tool body 23. In order that the motion of the jaw 22 in the sense of arrow B, i.e. toward the jaw 21, always be completely terminated, is the pair of pliers 20 provided, in the same region C as the pair of pliers 10, with the same locking mechanism 1 of FIG. 3.

Figure 3:
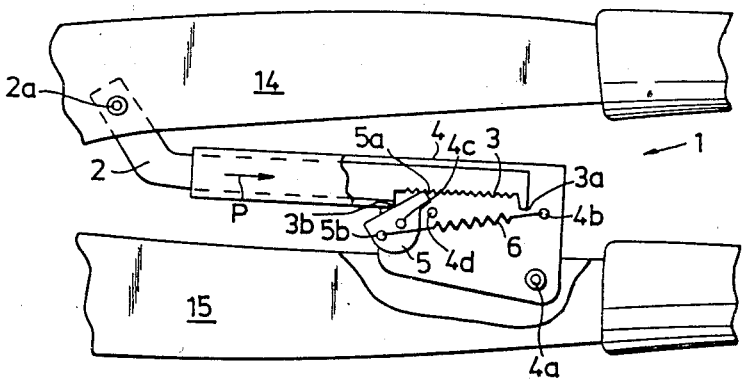
FIG. 3 is a side view, partially in section and on a larger scale, of the locking mechanism of FIGS. 1 and 2.

Turning now to FIG. 3, the locking mechanism 1 comprises a flat, edgeways mounted guiding bar 2 which is at its first end at 2*a* pivoted to one of the handles, handle 14 in the instance, and which is bent close to the pivot point. The guiding rod 2 is at its other end along a part of its longitudinal edge provided with a straight row of teeth 3 which extends between a first end and a second and which is somewhat sunk down relative to the remaining part of said edge, so that at each of said ends projects a corner 3*a*, 3*b* defining a projecting first and second end stop. The guiding rod 2, defining a carrier of the row of teeth 3, can freely glide in a housing 4 which at *4a* is pivoted to the other handle, i.e. handle 15. The pair of pliers 20 is in the region C arranged in the same way.

Figure 6:
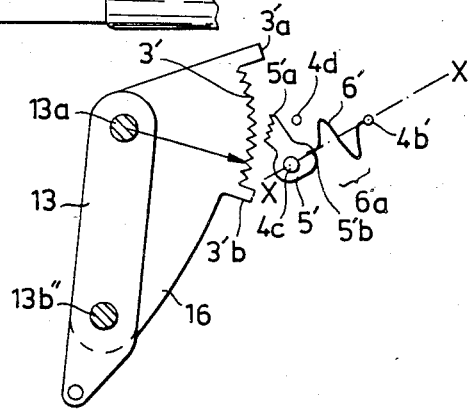
FIG. 6 shows more in detail the locking mechanism of FIG. 5.
Figure 7:
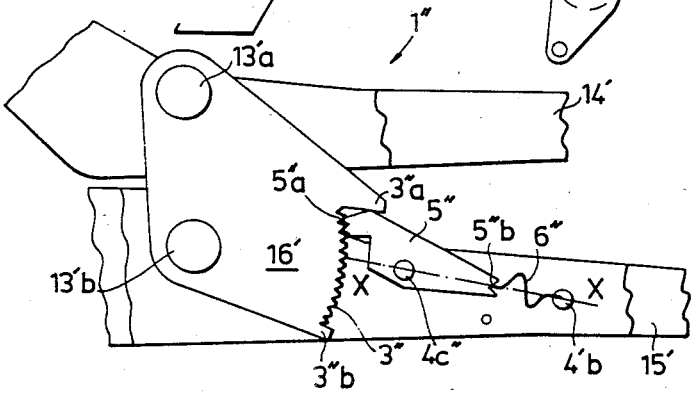
FIG. 7 is a side view of a modified embodiment of the locking mechanism of FIG. 6.

In the housing 4 there is a pawl 5 with a tip *5a*, defining an engagement part thereof, pivotally mounted with the aid of a pivot pin *4c* and is constantly affected by a helical extension spring 6. The pivot pin *4c* is underneath the pawl 5 anchored in the housing 4, but it does not project from the upper face of the pawl 5 visible in FIGS. 3 and 4. The first end of the extension spring 6 is at a first fixing point, e.g. defined by a first attachment pin *5b*, anchored on the pawl 5, and the second end of the spring 6 is at a second fixing point, e.g. defined by a second attachment pin *4b*, affixed to the housing 4. The wall of the housing 4, which for clarity has been broken away in FIG. 3, is a bit spaced from said upper face so as to leave place for the projecting end of the attachment pin *5b*. In an instable middle position of the pawl 5, not shown in FIGS. 3 and 4 (but cfr. FIGS. 6 and 7), the two said fixing points *4b* and *5b* and the pivot pin *4c* lie all on a straight line x—x (FIG. 4), the pivot pin *4c* being located between the two attachment pins *4b*, *5b*.

FIG. 3 shows the condition of the locking mechanism 1 shortly before the closed end position of the handles 14, 15 (or 24, 25) is reached. During the closing movement of the handles (and consequently also of the jaws), the guiding rod 2 has moved deeper into the housing 4 in the sense of arrow P. The pawl 5 was then in its first lateral position shown in FIGS. 3 and 4 in which the pawl 5, overcoming the force of the spring 6, effects small oscillatory movements corresponding to the height of the teeth in the row 3, as this row passes along the tip *5a*. These oscillatory movements never swing out the pawl 5 so far as into the said middle position.

At the end of travel, however, the pawl 5, as illustrated in FIG. 3, collides with the second end stop *3b* and is thereby, overcoming the force of the spring 6, swung into the middle position and a bit therebeyond and then, by the action of the spring 6, is rocked into a second lateral position defined by a side stop embodied e.g. by a stop pin *4d* mounted in the housing 4. The side stop *4b* is located so that, in the second lateral of the pawl 5, the engagement tip *5a* thereof—lies safely out of engagement with the row of teeth 3, but the pawl 5 as such, i.e. at least with some part, remains in the operative zone of the first end stop *3a* when the guiding rod 2 is moved so far against the sense of the arrow P.

Such a motion of the guiding rod 2 occurs when the handles (and the jaws) are again opened, i.e. moved one from another. This movement is now possible due to the fact that the engagement of the tip *5a* with the row of teeth 3 has been interrupted. From what has been said above it will be evident that this opening movement will be terminated as soon as the first end stop *3a* will affect the pawl 5 in the same manner as the second end stop *3b*, but in reverse sense, swinging it from the engagement-free second lateral position through the middle position back into the first lateral position for engagement with the row of teeth 3.

The pawl 5 operates thus as a bistable rocker moving in a space beside the row of teeth 3 and not, as in the known constructions, in a space (reversing gap) in longitudinal extension of the row of teeth. In particular the transition from the engagement-free position into the position for engagement demands in the mechanism according to the invention a smaller angle of aperture of the two handles than heretofore, and a greater angle is always less comfortable, and in the long run also more wearisome, for the user.

Figure 4:
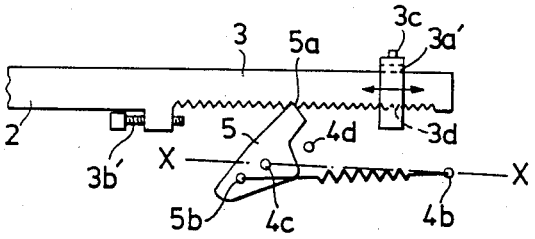
FIG. 4 is a side view of a modified embodiment of the locking mechanism of FIG. 3.

In order that the terminal and/or initial point of the handle movement might be set individually, can at least one of the end stops *3a*, *3b* of FIG. 3 be made settable as shown in FIG. 4 where by way of example two different constructions are shown. Either can a setting screw such as *3b'* be used, the end of which may be screwed out or in to a desired extent, or the end stop is embodied by a rider such as *3a'* which straddles the guiding rod 2 and by a screw *3c* can be fixed at a selected location. The guiding rod 2 passes through the rider *3a'* in an opening which is closed also adjacently the row of teeth 3 and which is somewhat higher than the cross-section of the guiding rod 2. The wall face in the opening which is turned toward the row of teeth 3 may be provided with at least one tooth *3d* matching with the teeth 3, so that when the screw *3c* is tightened, the tooth or teeth *3d* are lifted into engagement with the teeth 3.

Figure 5:
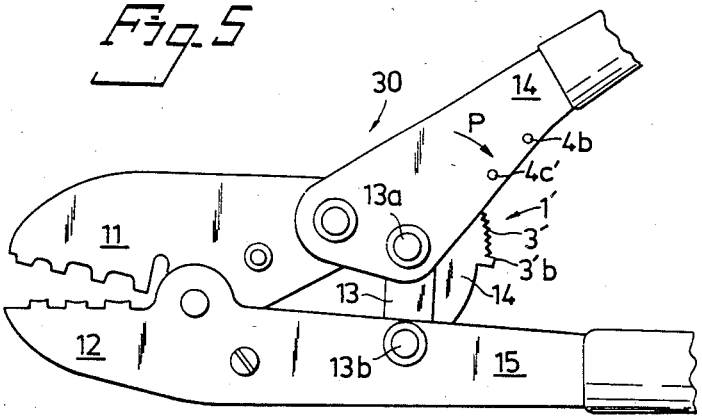
FIG. 5 is a side view of the front part of a pair of pliers provided with a second embodiment of the locking mechanism according to the invention.

In the embodiment 1' of the locking mechanism according to the invention illustrated in FIGS. 5 and 6 has a pair of pliers 30 in conformity with the pairs 10 and 20 two elongate handles 14, 15 and two jaws 11, 12. A connecting link 13 is with the aid of two pivot pin means *13a*, *13b* pivotally mounted between the handles 14, 15. On the same two pivot pin means *13a*, *13b* is also mounted a segment 16 pertaining to the locking mechanism 1' and provided along an edge with an arcuate row of teeth 3' having a center of curvature in the pivot pin means *13a*. The segment 16 defines a carrier of the row of teeth 3'. On both ends of the row of teeth 3' are provided projecting end stops *3'a* and *3'b*. A pawl 5' is pivotally mounted on a pivot pin *4c'* *affixed in the handle 14. Instead of the single engagement tip 5a* of the pawl 5, pawl 5' has at the corresponding location a short row of teeth *5'a* (FIG. 6) matching with the teeth of the row 3'. Such a solution has the advantage that, preserving the strength of the mechanism unchanged, the height of the teeth in the row 3' can be made lower, which gives smoother function when the pawl glides along the row of teeth, and greater wear resistance in general.

The first end of a leaf spring 6' is anchored in a first fixing point on the pawl 5', defined e.g. by a short slit *5'b* in the body of the pawl. The second end of spring 6' is in a second fixing point, embodied e.g. by holder pin *4b'* mounted in the handle 14. The leaf spring 6' is in its central, intermediate region *6'a* between the two ends clamped at the fixing points shaped in zigzag (in sinewave). The leaf spring 6' is thus longer than the distance between its two fixing points *4b'* and *5'b*. In the instable middle position of the pawl 5', shown in FIG. 6, lie the two fixing points *4b'*, *5'a* and the pivot pin *4c'* of the pawl 5' on a straight line x—x, and both said fixing points are on the same side of the pivot pin *4c'*. The locking mechanism 1' operates exactly in the same way as the locking mechanism 1.

The locking mechanism 1'' of FIG. 7 comprises a segment 16' which also fills the function of the connecting link 13 of FIG. 6 and which along an edge is provided with an arcuate row of teeth 3'' centered in the pivot pin *13'a*. End stops *3''a* and *3''b* limit the row of teeth 3'' and a pawl 5'' with a short row of teeth *5''a* engages therewith. It will be realised that the short row teeth *5''a* is located laterally of the connecting line x—x whereby a certain lever effect is obtained. Parts corresponding to those in FIG. 6 are denominated with reference numerals provided with one more prim stroke than in FIG. 6.

It will be realised that a factor contributing to a smoother operation of the locking mechanism according to the present invention, and effective also in embodiments where the pawl has an engagement tip instead of a short row of teeth, is the circumstance that upon opening of the handles the pawl is totally out of contact with the row of teeth, which is not the case in heretofore known constructions.

From the study of the drawings it will be understood that from the point of view of the present invention it is irrelevant if the row of teeth is straight or arcuate or if the pawl moves along the row of teeth, or vice versa, and if both handles or only one handle is pivotally mounted.

A short row of teeth such as 5'a on the pawl, and a co-operating arcuate row of teeth such as 3', have preferably the same curvature, i.e. that in the engagement position of the pawl 5', its row of teeth 5'a has a center of curvature at the same location as row 3' (i.e. in the pivot pins 13a or 13'a in the examples illustrated). If a short row of teeth on the pawl has to co-operate with straight row of teeth on the carrier, then it is of course also straight.

We claim:

1. Locking mechanism for preventing premature opening of a tool having two elongate handles and two jaws affected by said handles, the locking mechanism comprising a carrier of a row of teeth extending between a first end and a second end, said carrier being pivotally connected to one of the handles; a pawl pivotally mounted on a pivot pin and having an engagement part for engagement with said row of teeth; a spring means constantly affecting the pawl and mounted on one end at a first fixing point to the pawl and on the other end at a second fixing point to the tool and wherein the pawl is arranged to operate as a bistable rocker swingable from a first lateral position for engagement with the row of teeth through an instable middle position into a second engagement-free lateral position, a first and a second end stop which on impact with the pawl rock it from one lateral position through the middle position into the second lateral position projecting relative to the row of teeth at the said first and second ends; said first and second fixing points and said pivot pin lying all, in the middle position of the pawl, on one straight line, a side stop defining said second engagement free lateral position as a position in which the pawl as a whole remains in the operative field of one of the end stops so that upon impact of the pawl with said one of the end stops, the pawl is swung back from the second lateral position into the first lateral position.

2. The mechanism of claim 1, wherein the pivot pin is located between the two fixing points and the spring means is a helical extension spring.

3. The mechanism of claim 1, wherein both fixing points are located at the same side of the pivot pin and the spring means is a leaf spring which is longer than the distance between the fixing points.

4. The mechanism of claim 3, wherein the leaf spring is zigzag-shaped in its central region.

5. The mechanism of claim 1, farther comprising means to set the position of one of said end stops relative to the row of teeth.

6. The mechanism of claim 1, wherein the row of teeth is rectilinear.

7. The mechanism of claim 1, wherein the row of teeth is arcuate.

8. The mechanism of claim 1, wherein the pivot pin and the side stop are located on one of the handles.

9. The mechanism of claim 1, wherein the engagement part of the pawl is defined by a short row of teeth corresponding to the longer row of teeth on said carrier.

10. The mechanism of claim 1, wherein the engagement part of the pawl is defined by a tip for engagement with a single tooth of the said row of teeth.

11. The mechanism of claim 1, wherein the carrier is a segment, the row of teeth is located along one edge thereof and is arcuate having a center of curvature in a pivot pin on which the segment is mounted.

12. The mechanism of claim 11, wherein the engagement part of the pawl is defined by a short row of teeth corresponding to the row of teeth on the carrier, and being arcuate with the same center of curvature as the row of teeth on the carrier.

13. The mechanism of claim 12, wherein the row of teeth on the pawl is off-set laterally relative to the said straight line.

* * * * *